US011982160B1

(12) United States Patent
Ahmed et al.

(10) Patent No.: US 11,982,160 B1
(45) Date of Patent: May 14, 2024

(54) SYSTEMS FOR WASTE GAS SEQUESTRATION IN GEOLOGICAL FORMATIONS AND METHODS OF GAS SEQUESTRATION OF WASTE GASES IN GEOLOGICAL FORMATIONS

(71) Applicant: Saudi Arabian Oil Company, Dhahran (SA)

(72) Inventors: Zeyad Tareq Ahmed, Chassell, MI (US); Serguey Viktorov Arkadakskiy, Alberta (CA); Noushad Kunnummal, Cleveland Heights, OH (US)

(73) Assignee: Saudi Arabian Oil Company, Dhahran (SA)

( * ) Notice: Subject to any disclaimer, the term of this patent is extended or adjusted under 35 U.S.C. 154(b) by 58 days.

(21) Appl. No.: 17/971,970

(22) Filed: Oct. 24, 2022

(51) Int. Cl.
*E21B 41/00* (2006.01)

(52) U.S. Cl.
CPC ..... *E21B 41/0064* (2013.01)

(58) Field of Classification Search
CPC ..... E21B 41/0057; E21B 41/0064
See application file for complete search history.

(56) References Cited

U.S. PATENT DOCUMENTS

| | | | |
|---|---|---|---|
| 11,155,462 | B2 | 10/2021 | Arkadakskiy et al. |
| 2003/0047309 | A1 | 3/2003 | Thomas et al. |
| 2014/0020388 | A1 | 1/2014 | Salazar et al. |
| 2018/0264399 | A1 | 9/2018 | Deng et al. |

FOREIGN PATENT DOCUMENTS

| | | | |
|---|---|---|---|
| EP | 2584139 | A1 | 4/2013 |
| EP | 3868461 | A1 | 8/2021 |
| WO | 2020210138 | A1 | 10/2020 |
| WO | 2023087064 | A1 | 5/2023 |
| WO | 2023136917 | A1 | 7/2023 |

OTHER PUBLICATIONS

Notification of Transmittal of the International Search Report and Written Opinion of the International Searching Authority, or the Declaration dated Dec. 20, 2023 pertaining to International application No. PCT/US2023/034429 filed Oct. 4, 2023, pp. 1-14.

Gislason et al., "A brief history of CarbFix: Challenges and victories of the project's pilot phase", Energy Procedia, vol. 146, pp. 103-114, 2018.

Gunnarsson et al., "The rapid and cost-effective capture and subsurface mineral storage of carbon and sulfur at the CarFix2 site", Int. J. Greenhouse Gas Control, vol. 79, pp. 117-126, 2018.

Snaebjornsdottir et al., "Mineral Storage of CO2: Carbon dioxide storage through mineral carbonation", Nat Rev Earth Environ, vol. 1, pp. 90-102, 2020.

Syron et al., "Reducing the energy consumption of aerobic sewage treatment by removing the bubbles", 2nd IWA Specialized International Conference ecoSTP2014 EcoTechnologies for Wastewater treatment Technical, Environmental & Economic Challenges, Verona, Italy, Jun. 23-27, 2014.

*Primary Examiner* — Robert E Fuller
(74) *Attorney, Agent, or Firm* — DINSMORE & SHOHL LLP

(57) ABSTRACT

This disclosure relates to systems for waste gas sequestration in geological formations and methods for of gas sequestration of waste gas in geological formations. The system can include a wellbore, a casing, inner tubing, a water passage, outer tubing comprising a plurality of diffusion membranes, and a formation conduit comprising reactive rock.

20 Claims, 4 Drawing Sheets

SYSTEMS FOR WASTE GAS SEQUESTRATION IN GEOLOGICAL FORMATIONS AND METHODS OF GAS SEQUESTRATION OF WASTE GASES IN GEOLOGICAL FORMATIONS

FIELD

Embodiments disclosed herein generally relate to gas dissolution, and more specifically, to waste gas sequestration in geological formations.

TECHNICAL BACKGROUND

Sequestration of gases in a subsurface is desired in a variety of applications including, but limited to, reduction of greenhouse gases and gas storage. Depositing dissolved gas solutions within a geological formation can require drilling a hole from the surface to the geological formation. Specialized drilling techniques and materials are utilized to form the wellbore hole and enable the injection of dissolved gases and gas solutions into the formation. Specialized materials can be used to transport dissolved gas into a formation. A wellbore is a hole that extends from the surface to a location below the surface to permit access to formations. The wellbore contains at least a portion of a fluid conduit that links the interior of the wellbore to the surface. The fluid conduit connecting the interior of the wellbore to the surface may be capable of permitting regulated fluid flow from the interior of the wellbore to the surface and can permit access between equipment on the surface and the interior of the wellbore. The fluid conduit may be defined by one or more tubular strings, such as casings, inserted into the wellbore and secured in the wellbore.

SUMMARY

Gas sequestration in formations can include dissolving waste gas in injection fluid, such as an aqueous solution to form a dissolved gas solution and injecting the dissolved gas solution into formations. The systems and methods used can affect a concentration of the waste gas in the dissolved gas solution and the resulting waste gas sequestration. An ongoing need exists for sequestering waste gases into geological formations. As is described herein, embodiments include diffusion membranes positioned within a wellbore operable to permit waste gas flow into an aqueous solution stream and deliver aqueous waste gas solutions into reactive rock for gas sequestration. Embodiments described herein can be used for sequestration of waste gases into geological formations, such as a reactive rock formation.

According to one or more embodiments of the present disclosure, a system for waste gas sequestration in a geological formation can comprise a wellbore disposed within the geological formation, the geological formation comprising reactive rock, a casing disposed within the wellbore, inner tubing centrally disposed within the wellbore and extending downhole a depth within the wellbore, the inner tubing being a pathway for waste gas, a water passage disposed proximate an interior surface of the wellbore and extending downhole a depth within the wellbore, the water passage being a pathway for delivering an aqueous solution, outer tubing in fluid communication with and disposed about the inner tubing, the outer tubing comprising a plurality of chambers and a plurality of diffusion membranes disposed proximate or within the chambers, wherein the diffusion membranes are configured to selectively permit waste gas flow into an aqueous solution stream comprising at least a portion of the aqueous solution flowing within the outer tubing to thereby facilitate dissolution of the waste gas within the aqueous solution, and a formation conduit in fluid communication with the reactive rock and configured to deliver the solution of dissolved waste gas in the aqueous solution stream to the reactive rock for waste gas sequestration.

According to one or more embodiments of the present disclosure, a method of gas sequestration of waste gas in a geological formation can comprise forming a dissolved waste gas solution within a wellbore by: passing waste gas through an inner tubing, passing an aqueous solution into the wellbore through a water passage and an outer tubing comprising a plurality of diffusion membranes, and passing the waste gas through the diffusion membranes to be mixed with the aqueous solution in the outer tubing to produce the dissolved waste gas solution; transporting at least a portion of the dissolved waste gas solution to the geological formation, and sequestering the waste gas by reacting the waste gas in the dissolved waste gas solution with reactive rock in the geological formation to form carbonates, sulfides, or combinations thereof.

It is to be understood that both the preceding general description and the following detailed description describe various embodiments and are intended to provide an overview or framework for understanding the nature and character of the claimed subject matter. Additional features and advantages of the embodiments will be set forth in the detailed description and, in part, will be readily apparent to persons of ordinary skill in the art from that description, which includes the accompanying drawings and claims, or recognized by practicing the described embodiments. The drawings are included to provide a further understanding of the embodiments and, together with the detailed description, serve to explain the principles and operations of the claimed subject matter. However, the embodiments depicted in the drawings are illustrative and exemplary in nature, and not intended to limit the claimed subject matter.

BRIEF DESCRIPTION OF DRAWINGS

The following detailed description may be better understood when read in conjunction with the following drawings, in which.

DETAILED DESCRIPTION

Figure 1:
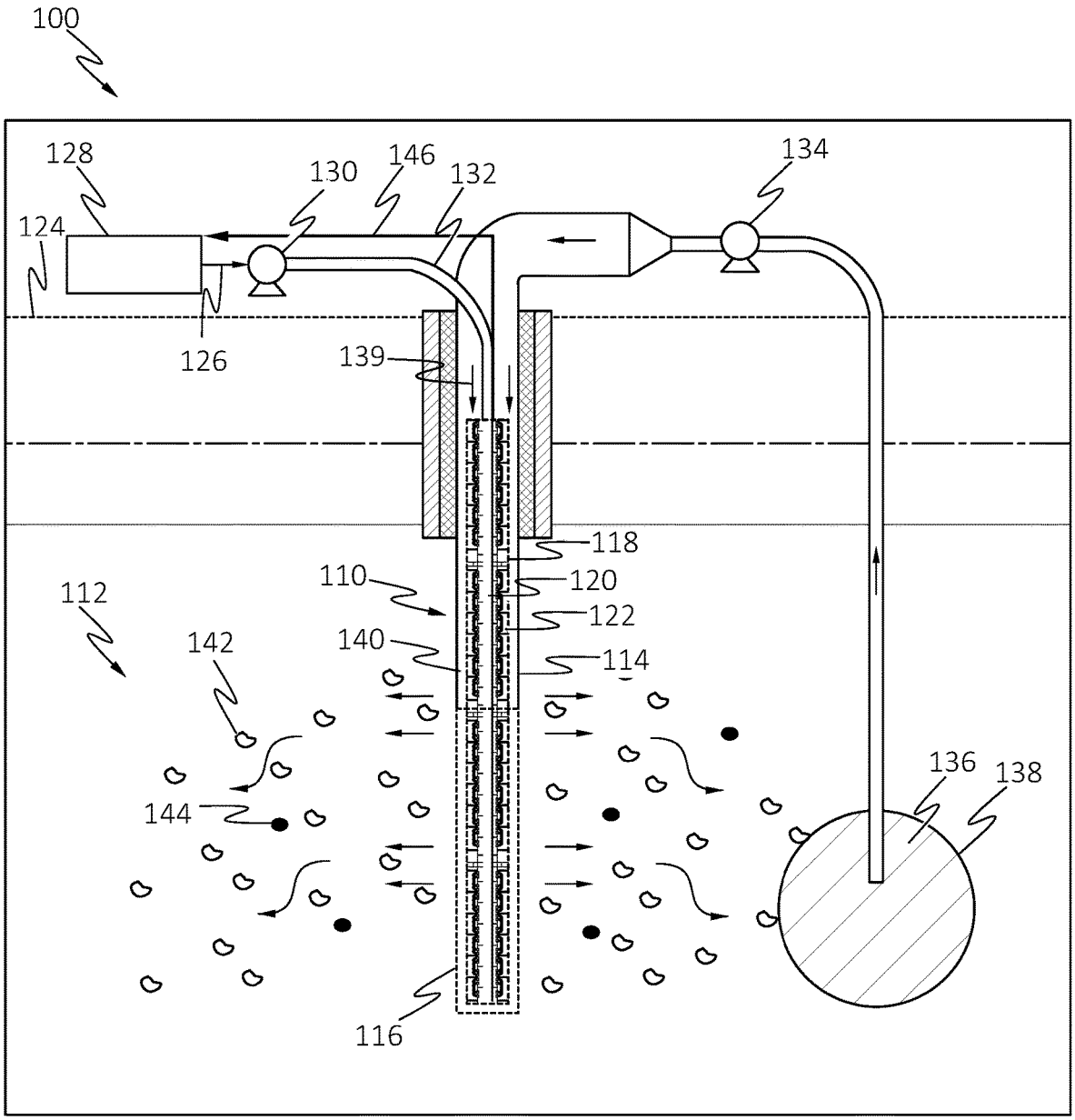
FIG. 1 is a schematic diagram of an embodiment of a system for gas sequestration, as described herein.

The present disclosure is generally directed to systems for waste gas sequestration in a geological formation and methods of sequestration of waste gases in a geological formation. The systems may generally include a wellbore disposed within a geological formation, a casing disposed within the wellbore, inner tubing centrally disposed within the wellbore and extending downhole a depth within the wellbore, where the inner tubing can be a pathway for waste gas, a water passage disposed proximate an interior surface of the wellbore and extending downhole a depth within the wellbore, the water passage being a pathway for delivering an aqueous solution, outer tubing in fluid communication with and disposed about the inner tubing, the outer tubing comprising a plurality of chambers and a plurality of diffusion membranes disposed proximate or within the chamber, and a formation conduit in fluid communication with the reactive rock. The methods may generally include forming a dissolved waste gas solution within a wellbore, and transporting at least a portion of the dissolved waste gas solution to the geological formation. According to some embodiments, such systems and methods may be particularly well suited for waste gas sequestration in geological formations.

As used throughout this disclosure, the term "wellbore" refers to a bored well within a formation capable of receiving injection water or other aqueous solutions. The wellbore can be vertical, horizontal, or positioned at any angle within the formation. A wellbore forms a pathway capable of permitting both fluids and apparatus to traverse between the surface and the formation. Besides defining the void volume of the wellbore, the wellbore wall also acts as the interface through which fluid can transition between the subterranean formation and the interior of the wellbore. The wellbore wall can be unlined (that is, bare rock or formation) to permit such interaction with the formation, or lined, such as by a tubular string, so as to prevent such interactions. As used throughout this disclosure, the term "fluid" can include liquids, gases, or both.

As used throughout this disclosure, the term "geological formation" refers to a body of rock that is sufficiently distinctive and continuous that it can be mapped, and can include a rock formation, a rock reservoir, a reactive rock formation, a reactive rock reservoir, water containing formation, or deep aquifer, among others. As used herein, reactive rock can comprise mafic rocks, ultramafic rocks and minerals and/or fragments thereof. The term mafic generally describes a silicate mineral or igneous rock that rich in magnesium and iron. Mafic minerals can be dark in color, and examples of rock-forming mafic minerals include olivine, pyroxene, amphibole, and biotite. Examples of mafic rocks include basalt, diabase, and gabbro. Examples of ultramafic rocks include dunnite, peridotite, and pyroxenite. Chemically, mafic and ultramafic rocks can be enriched in iron, magnesium, and calcium. A geological formation comprising mafic or ultramafic rock can allow components of an injected stream to react in situ with the mafic rock components to precipitate and store components of the injected stream in the formation. In some embodiments, the mafic rock comprises basaltic rock.

As used throughout this disclosure, the term "casing" or "cased portion" refers to a portion of the wellbore wherein fluids cannot penetrate the wellbore walls to reach the formation. The casing may include a metallic or non-metallic pipe inside the wellbore. The casing may be centralized within the wellbore. The space between the casing and the wellbore walls may be filled with materials, such as but not limited to cement to ensure well stability and/or zonal insulation. The casing can be disposed within at least a portion of the wellbore.

As used throughout this disclosure, the term "formation conduit" refers to a channel that fluidly connects the wellbore with the surrounding rock formation. A formation conduit can be in fluid communication with the reactive rock and be configured to allow fluids, such as a solution of one or more dissolved waste gases, to be delivered to the reactive rock. An "open hole interval portion" refers to a formation conduit, which can comprise an unlined portion of the wellbore wherein fluids can penetrate into the formation.

As used throughout this disclosure, the term "membrane unit" refers to a unit able to receive gases, liquids, other fluids, or combinations thereof, and where a gas can diffuse from one portion of the membrane unit to a second portion of the membrane unit. Gas can diffuse through a membrane element, such as a diffusion membrane, when a concentration of the gas is greater in one portion of the membrane unit compared to a second portion of the membrane unit. In embodiments, the diffusion membrane can utilize a single-component membrane, a multicomponent membrane, a selective single-component membrane, a selective multi-component membrane, or combinations thereof. In embodiments, the diffusion membrane can include a feed side where a gas enters the diffusion membrane, and a permeate side where at least a portion of the gas diffuses into.

As used throughout this disclosure, the term "gas" can refer to any gas or combination of gases. In embodiments, the gas may include, but not be limited to, $CO_2$, $H_2S$, $SO_2$, $N_2$, $Ar_2$, $O_2$, and combinations of two or more thereof. In embodiments, the gas can be a "waste gas". As used throughout this disclosure, the term "waste gas" refers to any gas or combination of gases that may be processed, stored, transported, or combinations thereof.

As used throughout this disclosure, the term "tubing" refers to a pipe, tube, or other enclosed structure. The tube can reside within a wellbore, outside of the wellbore, at a surface of the wellbore, or combination thereof, through which a fluid can be transported.

As used throughout this disclosure, the term "mass transfer rate" can refer to the rate at which a gas can be transported, which can include the transfer of a gas from a gas source into a formation. The mass transfer rate can be influenced by a combination of processes, including but not limited to, advection, diffusion, dissolution, and migration of injected solution into the formation. The mass transfer rate may be quantified by measuring the mass of a target gas injected into the wellbore and measuring a mass of the target gas returned to the surface of the formation, and calculating the difference between injected mass and returned mass per unit time.

Now referring to FIG. 1, an example system 100 that may be suitable for use with the methods and/or apparatuses described herein is schematically depicted. The system 100 generally comprises a wellbore 110 within a geological formation 112, a casing 114 disposed within the wellbore 110, inner tubing 120 centrally disposed within the wellbore 110 and extending downhole a depth within the wellbore 110, a water passage 139 disposed proximate an interior surface of the wellbore 110 and extending downhole a depth within the wellbore 110, outer tubing 118 in fluid communication with and disposed about the inner tubing 120, and a formation conduit, where the formation conduit can comprise an open hole interval portion 116 of the wellbore 110 in fluid communication with reactive rock 142 in the geological formation 112. In embodiments, the outer tubing 118 can run vertically in the wellbore 110 from a position below a surface 124 of the geological formation 112 within the casing 114, and end near a portion of the wellbore 110 in the open hole interval portion 116 of the wellbore 110. A feed gas stream 126 from a gas source 128 can be transported into the inner tubing 120 using a gas pump 130. The feed gas stream 126 can travel through a pipe 132 fluidly connected to the inner tubing 120. A water pump 134 can be used to pump an aqueous solution 136 within an aqueous solution source 138 in the formation 112 to the wellbore 110 through the water passage 139. At least a portion of the aqueous solution 136 in the water passage 139 can form an aqueous solution stream 122 that is fluidly connected to the outer tubing 118. At least a portion of the gas in the inner tubing 120 can flow into the outer tubing 118. The gas can be concentrated in the inner tubing 120, the outer tubing 118, or both the inner tubing 120 and the outer tubing 118. At least a portion of the gas in the outer tubing 120 can flow into the aqueous solution stream 122. At least a portion of the gas in the aqueous solution stream 122 can be dissolved in the aqueous solution stream 122 to form a dissolved waste gas solution 140. The dissolved waste gas solution 140 can flow into the rock formation 112 through the open hole interval portion 116 of the wellbore 110. In other embodiments, at least a portion of the gas in the aqueous solution stream 122 can dissolve in the aqueous solution stream 122 after the aqueous solution stream 122 flows into the rock formation 112 to form the dissolved waste gas solution 140. The dissolved waste gas solution 140 can interact with reactive rock 142 in the rock formation 112 to form secondary minerals 144 such as, but not limited to, carbonates and sulfides. Additionally, insoluble and undissolved gases in the outer tubing 118 can be transported to the surface 124 through a gas return pipe 146.

Figure 2:
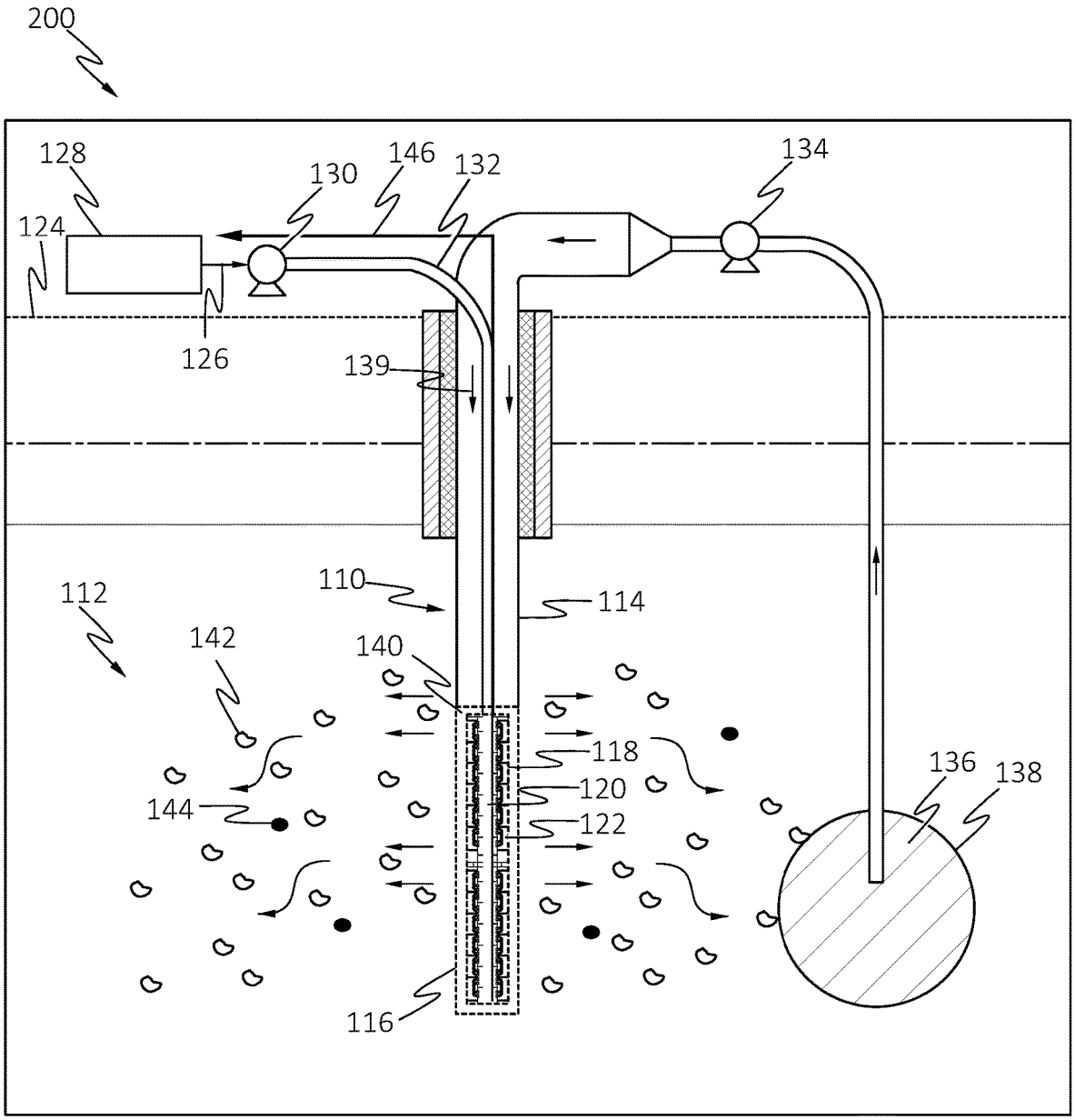
FIG. 2 is a schematic diagram of an embodiment of a system for gas sequestration, as described herein.

Referring to FIG. 2, an example system 200 that may be suitable for use with the methods and/or apparatuses described herein is schematically depicted. The example system 200 differs from the system 100 of FIG. 1 in that the outer tubing 118 in system 200 is centrally disposed within the open hole interval portion 116 of the wellbore 110, whereas the outer tubing 118 of system 100 is centrally disposed within both the casing 114 and the open hole interval portion 116 of the wellbore 110.

The wellbore 110 can include at least a portion of a fluid conduit (not shown) that links the interior of the wellbore 110 to the surface 124. The fluid conduit connecting the interior of the wellbore 112 to the surface 124 can permit regulated fluid flow from the interior of the wellbore 110 to the surface 124 or from the surface 124 to the interior of the wellbore 110. The fluid conduit can permit access between equipment on the surface 124 and the interior of the wellbore 112. Example equipment connected at the surface 124 to the fluid conduit includes pipelines, tanks, pumps, and compressors. The fluid conduit may be large enough to permit introduction and removal of mechanical devices, including but not limited to tools, drill strings, sensors, and instruments, into and out of the interior of the wellbore 110.

In embodiments, the system includes modular components. Suitable modular components include one or more, but not limited to the following: pipes, membrane elements, protective casings, and protective liners. One advantage of having a modular system is that it may be easier to extract individual modules for maintenance or replacement.

In embodiments, the casing 114 of the wellbore 110 can comprise cement, metal, nonmetallics, or a combination of two or more thereof. In embodiments, the casing 114 can further comprise other equipment, such as but not limited to, packers and spacers. In embodiments, the casing 114 can be operable to prevent fluid flow from the wellbore 110 into the surrounding geological formation 112.

In embodiments, the formation conduit, such as the open hole interval portion 116 of the wellbore 110, can be operable to allow fluids within the wellbore 110, such as the dissolved waste gas solution 140, to flow out of the wellbore 110 and flow into the surrounding formation. In embodiments, the open hole interval portion 116 can be absent of any casings, liners, or cement. In other embodiments, the open hole interval portion 116 can include additional support structures, such as slotted liners, casings, or even cement portions. Without being bound by any theory, it is believed that the additional support structures can improve the structural integrity of the open hole interval portion 116, which can increase the length of time the wellbore can be used without repair.

In embodiments, the outer tubing 118 can be positioned within both the casing 114 and the open hole interval portion 116 of the wellbore 110, as shown in system 100. Without intending to be bound by any particular theory, it is believed when the flow rate, or injectivity, of the aqueous solution 136 is high, it can be advantageous for the length of the outer tubing 118 to be positioned within both the casing 114 and the open hole interval portion 116 to accommodate a greater volume of the aqueous solution 136. Without being bound by any particular theory, it is believed that a longer outer tubing 118 spanning both the casing 114 and the open hole interval portion 116 can allow for an increased mass transfer rate of gas into the carrier water, and thus an increased mass transfer rate of the waste gas into the formation.

In embodiments, the outer tubing 118 can be positioned within the open hole interval portion 116 of the wellbore 110, as shown in system 200. Without intending to be bound by any particular theory, it is believed that the positioning of the outer tubing 118 within the open hole interval portion 116 of the wellbore 110 can increase gas solubility, within solubility limits, as the outer tubing 118 is deeper in the well and the pressure and temperature can be higher than a less deep position in the wellbore 110, such as within the casing 114 of the wellbore 110.

In embodiments, the outer tubing 118 can be positioned within the casing 114 of the wellbore 110 (not shown). Without intending to be bound by any particular theory, it is believed that if the flow rate of the aqueous solution 136 into the wellbore 110 is low, a longer outer tubing 118 may not be necessary. As such, the outer tubing 118 can be positioned within the casing 114 of the wellbore 110.

In embodiments, the gas can be from a gas source 128. In embodiments, the gas can be a gas mixture from a gas source 128, such as stack emissions. In embodiments, the gas source can be positioned outside of the formation. In embodiments, a gas pump 130 can direct the gas into the wellbore 110. In embodiments, a gas pump 130 can concentrate the gas and can direct it into the wellbore 110. In embodiments, the gas can be directed into the wellbore 110 from a feed gas stream 126. As used in this disclosure, the term "feed gas stream" refers to the composition of gases transported from the gas source 128 to the system. In embodiments, a gas pump 130 can direct the gas into the inner tubing 120 positioned within the wellbore 110. In embodiments, the gas can be transported through a pipe 132. In embodiments, the pipe 132 can have an opening wherein the gas can exit the pipe 132 and the gas can enter the inner tubing 120.

In embodiments, the gas from the gas source 128 can comprise $CO_2$. In embodiments the gas source 128 can comprise $CO_2$. In embodiments, the gas from the gas source 128 can be $CO_2$. In embodiments, the gas from the gas source 128 can comprise greater than or equal to 10 wt. %, greater than or equal to 20 wt. %, greater than or equal to 30 wt. %, greater than or equal to 40 wt. %, greater than or equal to 50 wt. %, greater than or equal to 60 wt. %, greater than or equal to 70 wt. %, greater than or equal to 80 wt. %, greater than or equal to 90 wt. %, greater than or equal to 95 wt. %, or even greater than or equal to 95 wt. % $CO_2$, based on the total weight of the gas from gas source 128. In embodiments, the gas from the gas source 128 can comprise up to 100 wt. %, up to 95 wt. %, up to 90 wt. %, up to 80 wt. %, up to 70 wt. %, up to 60 wt. %, or even up to 50 wt. %, $CO_2$, based on the total weight of the gas from the gas source 128. In embodiments, the gas source 128 can be $CO_2$. In embodiments, the gas from the gas source 128 can comprise $H_2S$. In embodiments, the gas from the gas source 128 can comprise greater than or equal to 10 wt. %, greater than or equal to 20 wt. %, greater than or equal to 30 wt. %, greater than or equal to 40 wt. %, greater than or equal to 50 wt. %, greater than or equal to 60 wt. %, greater than or equal to 70 wt. %, greater than or equal to 80 wt. %, greater than or equal to 90 wt. %, greater than or equal to 95 wt. %, or even greater than or equal to 95 wt. % $H_2S$, based on the total weight of the gas from gas source 128. In embodiments, the gas from the gas source 128 can comprise up to 100 wt. %, up to 95 wt. %, up to 90 wt. %, up to 80 wt. %, up to 70 wt. %, up to 60 wt. %, or even up to 50 wt. %, $H_2S$, based on the total weight of the gas from the gas source 128. In embodiments the gas source 128 can comprise $H_2S$. In embodiments, the gas from the gas source 128 can be $H_2S$. In embodiments, the gas source 128 can be $H_2S$. In embodiments, the gas from the gas source 128 can comprise $SO_2$. In embodiments the gas source 128 can comprise $SO_2$. In embodiments, the gas from the gas source 128 can be $SO_2$. In embodiments, the gas source 128 can be $SO_2$. In embodiments, the gas from the gas source 128 can comprise $CO_2$ and $H_2S$. In embodiments the gas source 128 can comprise $CO_2$ and $H_2S$. In embodiments, the gas from the gas source 128 can consist of $CO_2$ and $H_2S$. In embodiments, the gas source 128 can consist of $CO_2$ and $H_2S$. In embodiments, the gas from the gas source 128 can be selected from the group consisting of $CO_2$, $H_2S$, $SO_2$, and combinations of these.

In embodiments, a gas filter or gas separator can be used to purify a desired gas from the gas source 128 before introducing the gas to the inner tubing 120. Examples of suitable filter or separation techniques include, but are not limited to cyclones, baghouses, electrostatic precipitators, scrubbers, or combinations of two or more thereof.

In embodiments, a gas return pipe 146 can be connected to the wellbore 110. As used throughout this disclosure, the term "gas return pipe" refers to a pipe that is fluidly connected to the wellbore 110 and the surface 124 of the geological formation 112. Insoluble gases, undissolved gases, or both insoluble gases and undissolved gases in the outer tubing 118 can be transported out of the wellbore 110 and to the surface 124 of the geological formation 112 through the gas return pipe 146 as a return gas. The gas return pipe 146 can reside within the wellbore 110. A composition of the return gas can be monitored, further processed, vented, or combinations thereof.

In embodiments, an aqueous solution 136 can be added to the wellbore 110 through the water passage 139 disposed proximate an interior surface of the wellbore 110. In embodiments, the aqueous solution 136 can be sourced from an aqueous solution source 138. In embodiments, a water pump 134 can direct the aqueous solution 136 into the wellbore 110. In embodiments, the water pump 134 can direct the aqueous solution 136 into the outer tubing 118 as the aqueous solution stream 122. In embodiments, the rate of a flow of the aqueous solution 136 into the wellbore 110, the outer tubing 118 as the aqueous solution stream 122, or both, can be changed by modifying the water pump 134 based on the desired flow rate of the aqueous solution 136.

In embodiments, the aqueous solution 136 can include one or more of deionized, tap, distilled, or fresh waters; natural, brackish, or saturated salt waters; marine waters, natural hydrocarbon formation produced waters, or synthetic brines; filtered or untreated seawaters; mineral waters; treated or untreated wastewater; or other potable or non-potable waters containing one or more dissolved salts, minerals, or organic materials. In embodiments, the aqueous solution 136 can comprise at least 80 wt. %, at least 90 wt. %, at least 95 wt. %, at least 99 wt. %, at least 99.9 wt. % or even 100 wt. % of water.

In embodiments, at least 90 wt. %, at least 95 wt. %, or even at least 99 wt. % of the aqueous solution 136 by mass can be a brine solution. As used herein, the term "brine" can refer to a saturated solution of one or more alkali metal chlorides. For example, "brine" can refer to a saturated solution of NaCl, KCl, other water soluble salts, or mixtures thereof. Alternatively, the term "brine" can refer to naturally derived saltwater, for example, seawater or salt lake water, used in its natural state or after having undergone processing, such as filtration, to remove contaminants and large particles. In embodiments, the aqueous solution 136 can consist of brine.

In embodiments, the aqueous solution source 138 can be positioned within the geological formation. In embodiments, the aqueous solution source 138 can originate from the same zone within the geological formation 112 in which the wellbore 110 is located. Without intending to be bound by any particular theory, it is believed that if the aqueous solution source 138 originates within the same zone within the geological formation 112, it can reduce potential incompatibility issues such as scaling that could interfere with gas uptake and injectivity. Further, it is believed that sourcing the aqueous solution 136 from the geological formation 112 can prevent reservoir overpressure and/or undesired fluid migration out of the injection zone. Additionally, it is believed that sourcing the aqueous solution 136 from the geological formation 112 can improve monitoring of gas sequestration in the geological formation 112, as the composition of the aqueous solution 136 can be monitored.

In embodiments, the aqueous solution source 138 can be a well identical to the wellbore 110 in terms of mechanical properties, equipment, and completion. In embodiments, the aqueous solution source 138 can be a well differing from the wellbore 110 in terms of mechanical properties, equipment, and completion. For instance, the aqueous solution source 138 can be any well producing water. In embodiments, the aqueous solution source 138 can be operable to receive an injection of a waste solution from the wellbore 110. Without intending to be bound by any particular theory, it is believed that a system for transporting dissolved gases to a formation can be more efficient if the waste solution from the wellbore can be recycled back to the aqueous solution source 138.

In embodiments, the outer tubing 118 is positioned within the wellbore 110. In embodiments, the outer tubing 118 can comprise a plurality of diffusion membranes. In embodiments, the membranes can be a single-component membrane, a composite membrane, a selective multicomponent membrane, or combinations of these. As used herein, the term "single-component membrane" can refer to a membrane where the structural elements are made from the same material. As used herein, the term "composite membrane" can refer to a membrane where at least two structural elements of the membrane are made from different materials. As used herein, the term "selective multicomponent membrane can refer to a membrane where at least two structural elements of the membrane are made from different materials and the membrane can be configured to exclude the diffusion of one or more gases and include the diffusion of one or more other gases.

In embodiments, the outer tubing 118 can include a hollow fiber or spiral wound membranes. Hollow fibers can be tubes made of the membrane material. In embodiments, the gas can flow inside the tube and the aqueous solution stream 122 can flow outside the tube. In embodiments, the gas can be enter the membrane at the feed side of the membrane (e.g. inside of tube). In embodiments, the aqueous solution stream 122 can contact the permeate side of the membrane (e.g. outside of tube). The gas can diffuse from inside the tube and can dissolve at the surface outside the tube (permeate side) when it contacts the aqueous solution stream 122. In embodiments, the thickness of the tube, where the gas diffusion can occur is called a "membrane wall". In embodiments, wound membranes can be combined sheets of membrane, layered with highly porous support plates to allow the flow of gas in one portion of the membrane and the flow of liquid in another portion of the membrane. In embodiments, multiple layers of the membrane sheets and spacers can be rolled into one cylindrical unit. In embodiments, two or more hollow fibers can be connected. Exemplary examples of diffusion membranes can be gas permeable silicone or polydimethylsiloxane (PDMS) membranes.

In embodiments, the outer tubing 118 can include one or more membrane units. The outer tubing 118 can include only one membrane unit, or the outer tubing 118 can include two or more membrane units. The membrane units can be connected in series to form a longer outer tubing 118, in comparison to an outer tubing 118 that includes only one membrane unit. Without intending to be bound by any particular theory, it is believed that configuring the outer tubing 118 to include additional membrane units can increase the interface area, which may increase the mass transfer rate of the system.

In embodiments, the outer tubing 118 can be configured to receive the gas under countercurrent conditions, cocurrent conditions, or a combination thereof.

In embodiments, the aqueous solution stream 122 and the gas can be introduced to the outer tubing 118 such that the gas flows against the flow of the aqueous solution stream 122 under countercurrent conditions. As used throughout the disclosure, the term "countercurrent" or "countercurrent conditions" refers to such embodiments wherein the gas and aqueous solution stream 122 are introduced to the outer tubing 118 in a manner that results in the gas flowing in an opposing direction of the flow of the aqueous solution stream 122.

In embodiments, the outer tubing 118 can be configured to receive the waste gas under countercurrent conditions. In embodiments, the gas can enter the outer tubing 118 at a lower portion of the outer tubing 118, such as the lower 50% of the outer tubing 118 to the end distal to the surface 124 of the wellbore 110 based on the total length of the outer tubing 118. In embodiments, the gas can enter the outer tubing 118 at the lower 50%, 45%, 40%, 35%, 30%, 25%, 20%, 15%, 10%, 5%, or 1% of the end distal to the surface 124 of the wellbore 110 based on the total length of the outer tubing 118. In embodiments, the gas can be transported through inner tubing 120, where the gas can flow to a lower portion of the outer tubing 118, before the gas reaches a diffusion membrane that interfaces with the aqueous solution stream 122 of the outer tubing 118. Without intending to be bound by any particular theory, Without intending to be bound by any particular theory, it is believed that configuring the outer tubing 118 to receive gas under countercurrent conditions can result in, the lowest concentration of gas in the gas stream to be in contact with the aqueous solution stream 122 having a low concentration of gas at the top of the membrane unit 300. Thus, this configuration can establish a concentration gradient even when the gas has a lower concentration in the gas stream, which may facilitate higher gas removal efficiency from the gas stream, in comparison to a system configured under cocurrent conditions.

Figure 3:
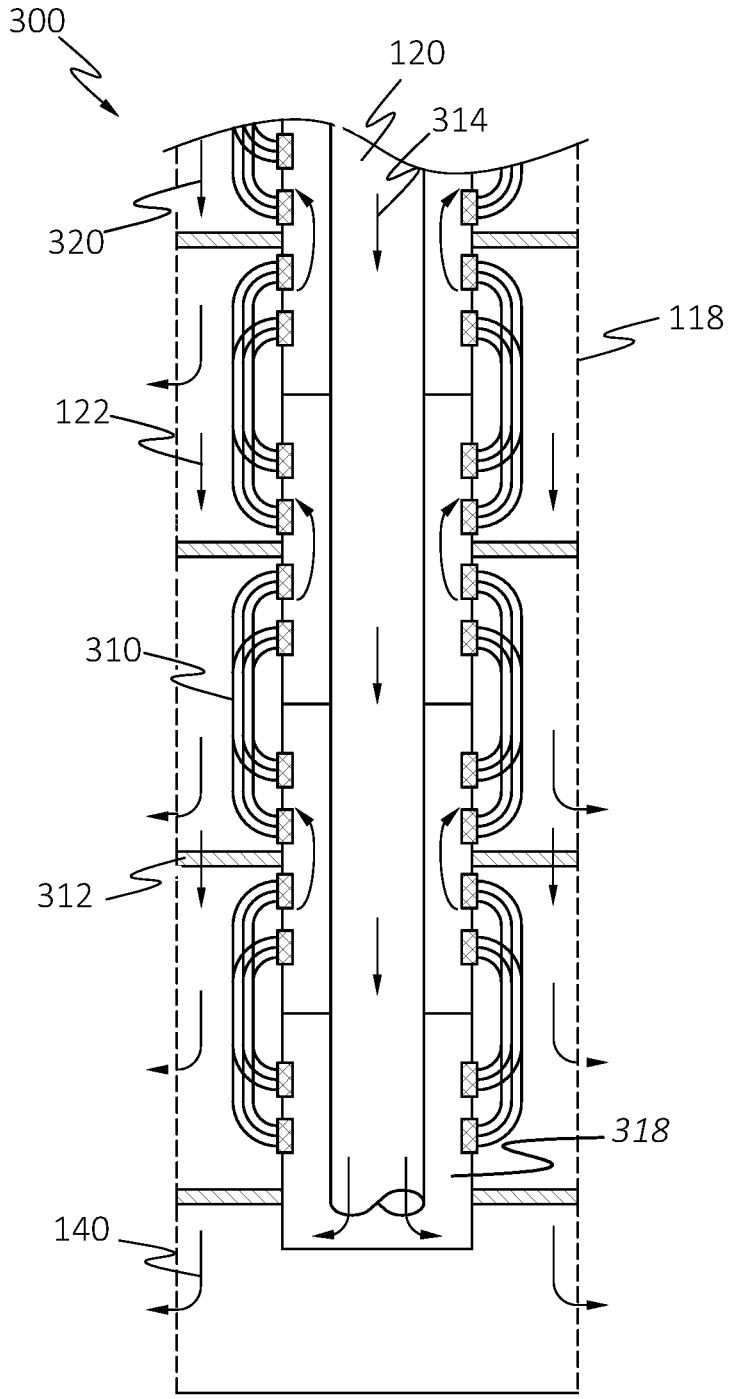
FIG. 3 is a schematic diagram of an embodiment of a membrane unit, as described herein.

Referring to FIG. 3, a schematic of an exemplary membrane unit 300 configured under countercurrent conditions is depicted. The membrane unit 300 can include the outer tubing 118 and the inner tubing 120. A gas stream 314 that includes a waste gas can travel within the membrane unit 300. The gas stream 314 can flow through inner tubing 120 to a lower portion of the membrane unit 300 and enter a first gas chamber 318 of outer tubing 118, where the first gas chamber 318 is positioned at the end distal to the surface 124 of the wellbore 110. The aqueous solution stream 122, which can include at least a portion of the aqueous solution 136, can enter a first water chamber 320 of outer tubing 118. One or more diffusion membranes 310 can be configured such that the gas flows inside (feed side) the diffusion membranes 310 and the aqueous solution stream 122 makes contact with an outside portion (permeate side) of the diffusion membranes 310 at a membrane-liquid interface. The gas inside the diffusion membranes 310 can diffuse through the diffusion membranes 310 and enter the water passage stream 122 to form a dissolved waste gas solution 140. The gas can flow from the first chamber 318 to the additional chambers in series, and the concentration of the gas can be reduced along this path within the gas chambers as more gas is diffused through the diffusion membranes 310 and is transported to the aqueous solution stream 122 along the path of the outer tubing 118. Without intending to be bound by any particular theory, it is believed the concentration of the gas in the gas chambers is the lowest in the gas chamber closest to the surface 124 under countercurrent conditions. The dissolved waste gas solution 140 can exit the outer tubing 118. The dissolved waste gas solution 140 can exit the wellbore 110 and enter a geological formation 112 through a formation conduit (not pictured). The undissolved gas in the gas chambers can be transported to the surface 124 for enrichment, disposal, treatment, or a combination thereof (not pictured). The membrane unit 300 can also include one or more spacers 312 to position and/or protect elements of the outer tubing 118. The one or more spacers 312 can also direct the aqueous solution stream 122 and/or the dissolved waste gas solution 140 to the membrane-liquid interface.

In embodiments, the aqueous solution stream 122 and the gas can be introduced to the outer tubing 118 such that the gas flows with the flow of the aqueous solution stream 122 under cocurrent conditions. As used throughout the disclosure, the term "cocurrent" or "cocurrent conditions" refers to such embodiments wherein the gas and aqueous solution stream 122 are introduced to the outer tubing 118 in a manner that results in the gas flowing in a similar direction of the flow of the aqueous solution stream 122.

In embodiments, the outer tubing 118 can be configured to receive the waste gas under cocurrent conditions. In embodiments, the gas can enter the outer tubing 118 at an upper portion of the outer tubing 118, such as the upper 50% of the outer tubing 118 to the end proximal to the surface 124 of the wellbore 110 based on the total length of the outer tubing 118. In embodiments, the gas can enter the outer tubing 118 at the upper 50%, 45%, 40%, 35%, 30%, 25%, 20%, 15%, 10%, 5%, or 1% of the end proximal to the surface 124 of the wellbore 110 based on the total length of the outer tubing 118. Without intending to be bound by any particular theory, it is believed that configuring the outer tubing 118 to receive gas under cocurrent conditions can result in a higher concentration gradient over the length of outer tubing 118 and achieve a higher overall mass transfer rate, in comparison to countercurrent conditions.

Figure 4:
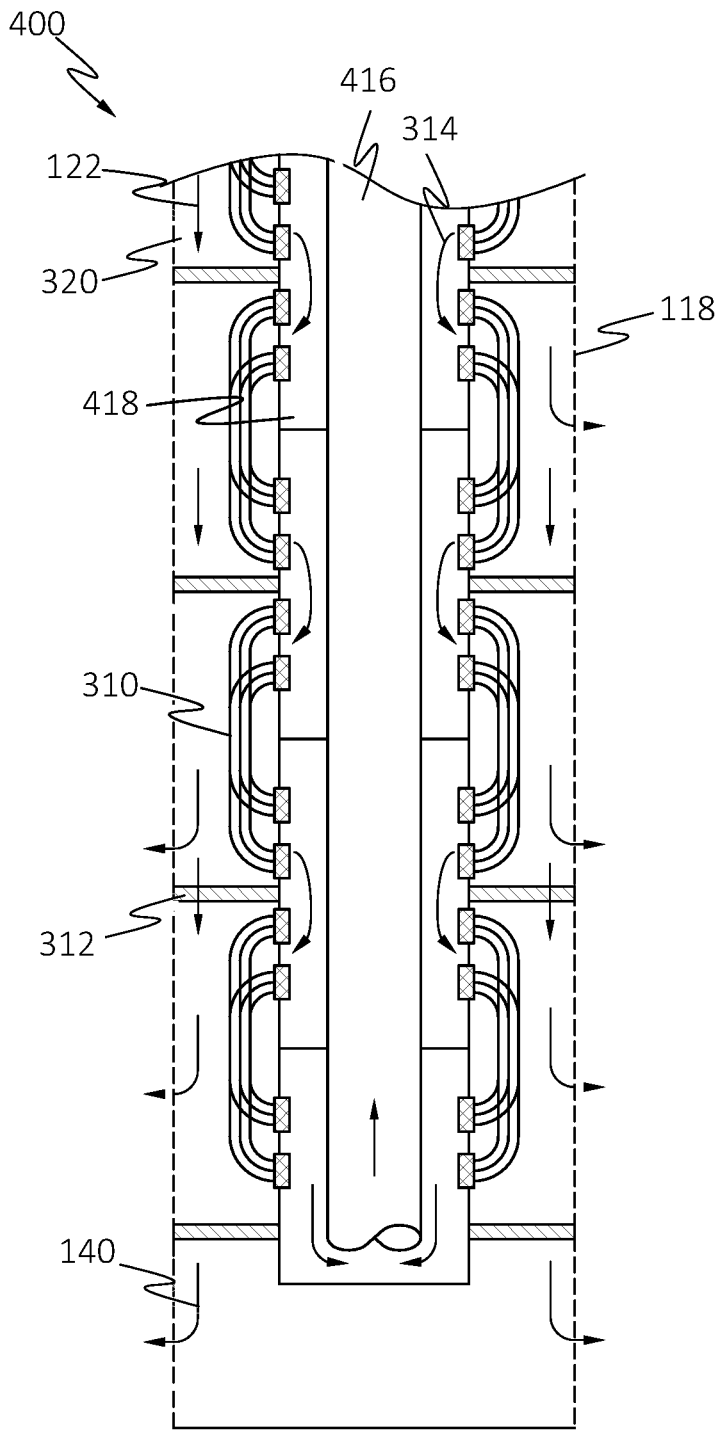
FIG. 4 is a schematic diagram of an embodiment of a membrane unit, as described herein.

Referring to FIG. 4, a schematic of an exemplary membrane unit 400 configured under cocurrent conditions is depicted. The membrane unit 400 can include the outer tubing 118. A gas stream 314 that includes a waste gas can travel from inner tubing 120 (not pictured) and enter the membrane unit 400. The gas stream 314 can enter a first gas chamber 418 positioned at the end proximal to the surface 124 of the wellbore 110. The aqueous solution stream 122, which can include at least a portion of the aqueous solution 136, can enter a first water chamber 320 of outer tubing 118. One or more diffusion membranes 310 can be configured such that the gas flows inside the diffusion membranes 310 and the aqueous solution stream 122 makes contact with an outside portion of the diffusion membranes 310 at a membrane-liquid interface. The gas inside the diffusion membranes 310 can diffuse through the diffusion membranes 310 and enter the aqueous solution stream 122 to form a dissolved waste gas solution 140. The gas can flow from the first chamber 318 to the additional chambers in series, and the concentration of the gas can be reduced along this path within the gas chambers as more gas is diffused through the diffusion membranes 310 and is transported to the aqueous solution stream 122 along the path of the outer tubing 118. Without intending to be bound by any particular theory, it is believed the concentration of the gas in the gas chambers is the lowest in the chamber furthest from the surface 124 under cocurrent conditions. The dissolved waste gas solution 140 can exit the outer tubing 118. The dissolved waste gas solution 140 can exit the wellbore 110 and enter a geological formation 112 through a formation conduit (not pictured). After the gas flows through the last diffusion 310 in the last chamber, the undissolved gas in the gas chambers can flow back to the surface 124 through an inner pipe 416 for enrichment, disposal, treatment, or a combination thereof. The membrane unit 400 can also include one or more spacers 312 to position and/or protect elements of the outer tubing 118. The one or more spacers 312 can also direct the aqueous solution stream 122 and/or the dissolved waste gas solution 140 to the membrane-liquid interface.

In embodiments, the diffusion-based membrane can be configured where the gas is introduced to the aqueous solution stream 122 in the outer tubing 118 under a combination of countercurrent and cocurrent conditions described previously (not pictured). For example, In embodiments, a cocurrent configuration can be used for one or more membrane units further from the surface 124, to facilitate a high mass transfer rate. A countercurrent setup can be simultaneously used for one or more membrane units to transport a return gas, which has low concentration of the desired gas at a part of the wellbore closer to the surface to facilitate higher gas removal efficiency.

In embodiments, the gas from the feed gas stream 126 can be concentrated in the gas chambers of the outer tubing 118 to form a concentrated gas solution. In embodiments, the concentrated gas solution can diffuse from the gas chambers of the outer tubing 118 to the liquid chambers of the outer tubing 118. In embodiments, the concentrated gas solution can dissolve in the aqueous solution stream 122 of the outer tubing 118 to form a dissolved waste gas solution 140. In embodiments, the dissolved gas in the dissolved waste gas solution 140 can be carried to a geological formation 112. The geological formation 112 can comprise reactive rock. Without intending to be bound by any particular theory, it is believed that the gas can diffuse from the gas chambers to the liquid chambers, driven by a gas phase concentration gradient between the gas chambers and the liquid chambers of the outer tubing 118. Further, it is believed that once the gas diffuses from the gas chambers of the outer tubing 118 and enters the liquid chambers of the outer tubing 118, soluble diffused gases can be dissolved in the aqueous solution stream 122 as the soluble diffused gases come in contact with the aqueous solution stream 122. It is believed that dissolution of the soluble diffused gases into the aqueous solution stream 122 that is flowing through the liquid chambers of the outer tubing 118 can create a local concentration gradient within the outer tubing 118 and can drive the diffusion process of the gas between the gas chambers and the liquid chambers of the outer tubing 118.

In embodiments, insoluble gases can diffuse through the diffusion membranes 310. However, as these gases don't dissolve in the aqueous solution stream 122, a concentration gradient of the insoluble gases may not be generated in the outer tubing 118. Without being bound by any particular theory, it is believed that the concentration of the insoluble gases can reach equilibrium inside the diffusion membranes, and diffusion of insoluble gases can be stopped or reduced when equilibrium is reached.

In embodiments, the liquid chambers of the outer tubing 118 can be fluidly connected to a formation, such as the reactive rock formation 112. As used in this disclosure, the term "fluidly connected" refers to a configuration wherein fluids can flow from one component to another, but they need not be directly connected together. Without intending to be bound by any particular theory, it is believed that the aqueous solution stream 122 of the outer tubing 118 can dissolve waste gas to form the dissolved waste gas solution 140. In embodiments, the dissolved waste gas solution 140 can carry a waste gas to the formation. In embodiments, a portion of the waste gas in the dissolved waste gas solution 140 can be undissolved waste gas. In embodiments, at least a portion of the undissolved waste gas in the dissolved waste gas solution 140 can be dissolved in the dissolved waste gas solution 140 after the dissolved gas solution exits the outer tubing 118. As injection of the dissolved waste gas solution 140 into the geological formation continues, the waste gas can be carried further into the formation where it reacts or it may migrate further into the formation. Without intending to be bound by any particular theory, it is believed the mass transfer mechanism for the waste gas in the dissolved waste gas solution 140 to the geological formation can be advection. Further it is believed the mass transfer mechanism can be dependent on an injection rate of the aqueous solution 136 into the wellbore 110, as the injection rate of the aqueous solution 136 can determine, in part, the injection rate of the dissolved waste gas solution 140 into the formation.

In embodiments, a driving force of the diffusion of waste gas from the gas chambers to the liquid chambers of the outer tubing 118 can be the concentration gradient, which drives the transfer of the waste gas out of the gas chambers of the outer tubing 118 and into the liquid chambers of the outer tubing 118. As used herein the term "concentration gradient" refers to the gradual change in the concentration of solutes in a solution as a function of distance through a solution. Without intending to be bound by any particular theory, it is believed that several factors can affect the mass transfer rate of gases into the formation. It is believed that these factors can include the diffusion gradient inside the diffusion membranes (intermembrane diffusion) as well as the gradient in a film that forms at the surface of the diffusion membrane. As the diffusion gradient increases, the mass transfer rate can increase. The rate of solubility of the gas in the aqueous solution stream 122 at the membrane-liquid interface of the diffusion membrane 310 can also affect the mass transfer rate. For instance, as the rate of the solubility of the waste gas in the aqueous solution stream 122 at the membrane-liquid interface increases, the mass transfer rate can increase. The intermembrane diffusion rate can be governed by a membrane diffusion coefficient and the concentration gradient between the gas inside the diffusion membrane 310 and the concentration of the gas in the dissolved waste gas solution 140 at the exterior surface of the membrane-liquid interface. As the intermembrane diffusion rate increases, the mass transfer rate can increase. A film diffusion rate can be affected by a diffusivity of dissolved gas in the dissolved waste gas solution 140. As the diffusivity of gas in the dissolved waste gas solution 140 increases, the rate of mass transfer can increase. A liquid phase concentration gradient can be affected by the advective transport of the aqueous solution stream 122, which is governed by the water velocity, the water injection rate, or a combination thereof, among others. As the liquid phase concentration gradient increases, the rate of mass transfer can increase. As used herein, the term "advective transport" refers to the transport of a substance or material by bulk motion of a fluid. Gas to dissolved waste gas solution 140 mass transfer can continue for as long as the concentration gradient is maintained between the gas chambers of the outer tubing 118 and the liquid chambers of the outer tubing 118.

In embodiments, the outer tubing 118 can be configured to receive gas under cocurrent conditions, countercurrent conditions, or a combination thereof, considering factors such as the waste gas concentration, the waste gas stream pressure, availability and cost of gas enrichment to increase concentration, composition of the waste gas, allowable discharge to atmosphere limits, availability of water for injection, energy requirement for injection vs concentration enrichment, among others. Other factors that may be considered are physical properties of the formation such as, but not limited to, porosity, permeability, or volume. For instance, in embodiments where the permeability of the formation is low, it may be advantageous to configure the outer tubing 118 to receive gas under countercurrent conditions to reach a higher possible gas removal efficiency. As the return gas would contain a lower concentration of undissolved gases, surface facilities to process the return gas could be simplified. Without intending to be bound by any particular theory, it is believed that under conditions where a system is operating under favorable PTX (high pressure, low temperature, and high concentration of waste gas) and high permeability, it can be advantageous to configure the outer tubing 118 to receive gas under cocurrent conditions and design for maximum mass transfer rate to sequester higher masses of gases within a formation in a given time. However, under a cocurrent setup, the return gas can have an increased concentration of undissolved gas. The undissolved gas can be enriched at the surface and reinjected into the wellbore. Accordingly, a cost-effective approach for system design can balance the number of wellbores (determined by PTX properties and permeability) against the cost of gas processing and enrichment facilities at the surface of the formation to determine a preferred operational setup of embodiments described herein.

In embodiments, the gas can be transported into the gas chambers of the outer tubing 118 within the wellbore 110 and the aqueous solution 136 can be transported into the wellbore 110 such that at least a portion of the aqueous solution 136 enters the liquid chambers of the outer tubing 118 as the aqueous solution stream 122. The gas and the aqueous solution 136 can be independently transported into the wellbore at a controlled rate to ensure efficient advective transport to carry dissolved gas into the formation. In embodiments, the dissolved gas can comprise $CO_2$ and can be transported inside a geological formation comprising reactive rock for mineral carbonation.

In embodiments, the dissolved waste gas solution 140 within the outer tubing 118 can exit the wellbore 110 through a formation conduit, such as the open-hole portion 116 of the wellbore 110. In embodiments, the dissolved waste gas solution 140 can flow into a surrounding formation, such as the geological formation 112.

In embodiments, the liquid chambers of the outer tubing 118 can be flushed with an aqueous solution stream 122 that is not saturated with the waste gas. Without intending to be bound by any particular theory, it is believed that continuously flushing the liquid chambers of the outer tubing 118 with the aqueous solution stream 122 can increase the mass transfer rate of waste gas into the geological formation 112. Further, it is believed that flushing the liquid chambers of the outer tubing 118 with an aqueous solution stream 122 having a lower dissolved gas content can result in a greater mass transfer rate.

In embodiments, the gas in the dissolved waste gas solution 140 can be secured within a formation, such as the geological formation 112 through mineral trapping. As used in this disclosure, the term "mineral trapping" can refer to the reaction of gas in a solution with materials in a formation to form minerals. In embodiments, the gas in the dissolved waste gas solution 140 can be $CO_2$. Without intending to be bound by any particular theory, it is believed that when $CO_2$ dissolves in the aqueous solution stream 122 to form a dissolved waste gas solution 140, carbonic acid can form in the dissolved waste gas solution 140, and the carbonic acid can interact with the surrounding formation to form carbonates. It is further believed that the formed carbonates are stable and can effectively trap the $CO_2$ within the formation. In embodiments, the dissolved waste gas solution 140 can comprise hydrogen sulfide. In embodiments, the dissolved waste gas solution 140 can comprise sulfur dioxide. In embodiments, the dissolved waste gas solution 140 can interact with the reactive rock to form sulfides.

In embodiments, the gas in the dissolved waste gas solution 140 can be secured within a geological formation through solubility trapping. As used in this disclosure, the term "solubility trapping" can refer to storing gases dissolved in the aqueous solution stream 122 in the interstitial spaces of formations of different mineral compositions including, but not limited to, basalts, ultramafic rocks, granite, sandstones, conglomerates, shales and any other porous rocks. The term "solubility trapping" can also refer to the sinking of gas-rich solutions towards the bottom of a formation or a reservoir, displacing less dense, gas-poor ambient formation waters. In embodiments, the gas in the dissolved waste gas solution 140 can be $CO_2$. Without intending to be bound by any particular theory, it is believed that when $CO_2$ or other gases dissolve in the aqueous solution stream 122 to form the dissolved waste gas solution 140, the density of the dissolved waste gas solution 140 can be greater than other surrounding fluids in the formation or reservoir and can sink to the bottom of the formation over time, trapping the gas in the dissolved waste gas solution 140 within the geological formation 112.

In embodiments, at least a portion of undissolved waste gas within the outer tubing 118 can be transported to the surface 124 of the geological formation 112, and a composition and/or concentration of the undissolved waste gas can be monitored. In embodiments, the undissolved waste gas can flow out of the outer tubing 118 and be transported to the surface 124 through a gas return pipe 146. The composition and concentration of the undissolved waste gas flowing out of the outer tubing 118 can be monitored to assess the efficiency of gas dissolution into the aqueous solution stream 122. Without intending to be bound by any particular theory, it is believed that a greater amount of undissolved waste gas detected at the surface 124 of the geological formation 112 suggests less efficient dissolution of gas in the aqueous solution stream 124. Further, it is believed that by monitoring a concentration of the undissolved waste gas at the surface 124, the amount, or rate of waste gas transferred into the formation can be calculated. For instance, the amount of undissolved waste gas at the surface 124 can be subtracted from the amount of waste gas injected into the wellbore to provide an amount of waste gas that enters the geological formation for sequestration.

In embodiments, the concentration of the gas sequestered in the geological formation can be increased by changing the operation conditions. Without intending to be bound by any particular theory, it is believed that the concentration of the waste gas sequestered in the geological formation is dependent on a gas concentration in the feed gas stream 126, an aqueous solution 136 pumping rate, a permeability of the diffusion membranes 310, and the pressure, the temperature and the composition of the aqueous solution 136 that is added to the wellbore. For instance, if the concentration of the waste gas in the feed gas stream 126 is increased, the concentration of the waste gas in the formation can increase. If the aqueous solution 136 pumping rate increases, the concentration of the waste gas in the formation can increase as this can increase the concentration gradient between the gas chambers and liquid chambers of the outer tubing 118. As the permeability of the diffusion membranes 310 increase, the concentration of the waste gas in the geological formation can increase. As pressure, temperature, or both pressure and temperature of the aqueous solution 136 injected into the wellbore 110 increases, the concentration of the gas in the formation can increase. In embodiments, as the concentration of the waste gas in the geologic al formation increases, the mass-transfer rate of the waste gas into the geological formation increases.

In embodiments, a flow rate of the waste gas, a flow rate of the aqueous solution 136, a pressure of the waste gas, a pressure of the aqueous solution 136, a gas concentration in the feed gas stream 126, or combination of two or more can be independently changed so as to increase a concentration of the waste gas in the dissolved waste gas solution 140, as determined by the monitoring of the undissolved waste gas. In embodiments, a composition of the aqueous solution 136 within the geological formation 112 can be monitored to determine what adjustments can be made to increase a concentration of the waste gas in the dissolved waste gas solution 140.

In embodiments, the waste gas can enter the outer tubing 118 under cocurrent conditions, countercurrent conditions, or both cocurrent conditions and countercurrent conditions, as described herein.

In embodiments, the undissolved gases can comprise $CO_2$, $H_2S$, $SO_2$, $O_2$, $Ar_2$ or combinations of these. In embodiments, $Ar_2$ can be added to the feed gas stream 126 and enter the outer tubing 118 to monitor the rate of mass transfer. For instance, $Ar_2$ is soluble and inert, so monitoring the $Ar_2$ concentration can provide a mass transfer rate independent of the geological formation reactivity.

In embodiments, a portion of the gas from the gas source 128 can include insoluble gases to maintain a desired pressured within the outer tubing 118. For instance, a high differential pressure between the gas chambers of the outer tubing 118 and the liquid chambers of the outer tubing 118, or a high differential pressure between two or more portions of the membrane can result in collapse of the membrane. In embodiments, the insoluble gases can include $N_2$.

In embodiments, a concentration and/or composition of the aqueous solution 136 within the formation can be monitored. In embodiments, the aqueous solution 136 within the formation can be transported to the surface 124 as a return water stream and the composition of the return water stream can be analyzed. For example, the detection of dissolved gas, such as $CO_2$ in the return water stream can indicate a plume of $CO_2$-rich water has begun to reach the aqueous solution source 138. By monitoring a rate of the dissolved $CO_2$ concentration in the return water stream, a determination of the remaining formation capacity for additional $CO_2$, or other waste gases, can be made. Further, a determination of the time point where it can be more economically advantageous to move to a different wellbore 110 can be made. Additionally, when transporting the dissolved waste gas solution 140 into the reactive formation 112, the concentration of a target gas in the outer tubing 118 can be changed by adjusting the gas source 128 settings, gas pump 130 settings, or a combination of the gas source 128 and gas pump 130 settings, such as flow rate and pressure. The concentration of a target gas in the outer tubing 118 can be changed to adjust the mass transfer rate of the target gas in the formation and allow for the continued precipitation of secondary minerals to take place even after dissolved gas is detected in the return water stream in order to utilize more capacity of the formation.

In embodiments, methods can be used to separate undesired impurities in the feed gas stream 126 before introducing the gas to the inner tubing 120. In embodiments, methods can be used to modify PTX properties of the aqueous solution 136. Non-limiting examples to modify the pressure, temperature, composition, or combinations thereof of the aqueous solution 136 can include target gas enrichment methods such as amine absorption/adsorption, pressure swing adsorption, cryogenic separation, or other methods that may result in a change of the PTX properties of the aqueous solution 136.

Embodiments herein may be useful over a wide range of formation conditions, including temperatures from 10° C. to 300° C., and pressures from 100 kilopascals (kPa) to less than 9000 kPa, for example. Without intending to be bound by any particular theory, it is believed that at temperatures below 10° C., $CO_2$ may react with water to form a waxy substance called clathrate that may significantly reduce formation porosity and decrease injectivity. Further, it is believed that at temperatures above 300° C., calcite can be unstable, breaking down to form wollastonite and $CO_2$, thus reducing the mass of $CO_2$ captured in the formation. Further, it is believed that at pressures below 100 kPa, $CO_2$ saturation concentrations are too low for economical mass transfer. Additionally, at pressures above 9000 kPa, $CO_2$ can form a single-phase supercritical liquid and limit diffusion through a diffusion membrane 310 of the outer tubing 118.

Some conventional mass transfer technologies used to produce dissolved $CO_2$ water mixtures injected in reservoirs include water scrubbing of $CO_2$-bearing gas mixtures (e.g. flue gas) at a surface of the formation or bubble aeration of $CO_2$ in carrier water performed inside the casing of an injection well. Scrubbing of $CO_2$ involves pressurizing both the gas mixture and carrier water and letting those mix in a countercurrent mode inside a vertical scrubbing tower with water soluble gases such as $CO_2$, $H_2S$, and $SO_2$ dissolving in the water, while insoluble gases such as $N_2$ collect at the top of the vertical scrubbing tower and are vented to air. Aeration, on the other hand, involves the release of pure $CO_2$ bubbles in a downward stream of carrier water where $CO_2$ is dissolved prior to entering the storage reservoir. Because the solubility of $CO_2$ in water is highly pressure dependent, much of the cost of carbon sequestration can be related to compressing the $CO_2$ and/or carrier water before mixing. For example, the theoretical weight ratio of $H_2O$ to $CO_2$ in a $H_2O$-pure $CO_2$ mixture at 20 to 30 bar is approximately 22 tons: 1 ton to 33 tons: 1 ton. Therefore, a significant cost associated with carbon sequestration in rock formations is related to the cost of gas/water compression. The inefficient mass transfer of $CO_2$ to water caused by the less than optimal mass transfer effectiveness of conventional processes such as scrubbing or aeration could add significantly to the operational costs because of the need for pumping more water to deliver the same amount of $CO_2$ and/or needing a larger number of wellbores. In addition, even minor pressure changes during bubble aeration inside the wellbore can result in accidental gas build up and operational issues. Therefore, any process that can improve the effectiveness of $CO_2$ dissolution or other waste gases, such as embodiments disclosed herein, can significantly improve the economics of gas sequestration in rock formations.

Embodiments disclosed herein can optimize the dissolution of gases, such as but not limited to $CO_2$, hydrogen sulfide ($H_2S$), sulfur dioxide ($SO_2$), or mixtures thereof, in aqueous solution for the purpose of gas sequestration in a geological formation; reduce the energy cost of compressing gas or gas mixtures, while maintaining the same level of gas concentration in the aqueous solution; optimize $CO_2$ or other gas uptake in a formation using a formation conduit in the wellbore; reduce the aqueous solution injection volume required; improve process rate control and efficiency by monitoring return gas composition and aqueous solution stream composition; and reduce the risk of injection issues and/or $CO_2$ leaks caused by incomplete $CO_2$ dissolution, among other benefits.

According to an aspect, either alone or in combination with any other aspect, a membrane-based system for transporting dissolved gases to a formation includes a wellbore disposed within the geological formation, the geological formation comprising reactive rock, a casing disposed within the wellbore, inner tubing centrally disposed within the wellbore and extending downhole a depth within the wellbore, the inner tubing being a pathway for waste gas, a water passage disposed proximate an interior surface of the wellbore and extending downhole a depth within the wellbore, the water passage being a pathway for delivering an aqueous solution, outer tubing in fluid communication with and disposed about the inner tubing, the outer tubing comprising a plurality of chambers and a plurality of diffusion membranes disposed proximate or within the chambers, wherein the diffusion membranes are configured to selectively permit waste gas flow into an aqueous solution stream comprising at least a portion of the aqueous solution flowing within the outer tubing to thereby facilitate dissolution of the waste gas within the aqueous solution, and a formation conduit in fluid communication with the reactive rock and configured to deliver the solution of dissolved waste gas in the aqueous solution stream to the reactive rock for waste gas sequestration.

According to a second aspect, either alone or in combination with any other aspect, the outer tubing is positioned within the casing disposed within the wellbore.

According to a third aspect, either alone or in combination with any other aspect, further comprising a plurality of spacers disposed proximate or within the outer tubing.

According to a fourth aspect, either alone or in combination with any other aspect, wherein a membrane unit comprises a portion of the outer tubing and the plurality of membrane units are connected in series between adjacent chambers.

According to a fifth aspect, either alone or in combination with any other aspect, wherein the diffusion membranes are disposed along an outer surface of the chambers adjacent the water passage.

According to a sixth aspect, either alone or in combination with any other aspect, wherein the diffusion membranes comprise silicone, polydimethylsiloxane, or combinations thereof.

According to a seventh aspect, either alone or in combination with any other aspect, further comprising an aqueous solution source within the geologic formation in fluid communication with the water passage.

According to an eighth aspect, either alone or in combination with any other aspect, further comprising a water pump disposed between the aqueous solution source and the water passage.

According to a ninth aspect, either alone or in combination with any other aspect, further comprising a gas pump in communication with the inner tubing.

According to a tenth aspect, either alone or in combination with any other aspect, further comprising a gas return passage disposed between the outer tubing and a surface of the geological formation, the gas return passage being a pathway for undissolved or insoluble gases in the outer tubing to reach the surface of the geological formation.

According to an eleventh aspect, either alone or in combination with any other aspect, wherein the formation conduit comprises an unlined portion of the wellbore at a downhole end of the formation conduit.

According to a twelfth aspect, either alone or in combination with any other aspect, wherein the outer tubing is disposed within the unlined portion of the wellbore.

According to a thirteenth aspect, either alone or in combination with any other aspect, wherein the outer tubing is disposed within both the casing and the unlined portion of the wellbore.

According to a fourteenth aspect, either alone or in combination with any other aspect, a method of gas sequestration of waste gas in a geological formation comprises forming a dissolve d waste gas solution within a wellbore by: passing waste gas through an inner tubing, passing an aqueous solution into the wellbore through a water passage and an outer tubing comprising a plurality of diffusion membranes, and passing the waste gas through the diffusion membranes to be mixed with the aqueous solution in the outer tubing to produce the dissolved waste gas solution; transporting at least a portion of the dissolved waste gas solution to the geological formation, and sequestering the waste gas by reacting the waste gas in the dissolved waste gas solution with reactive rock in the geological formation to form carbonates, sulfides, or combinations thereof.

According to a fifteenth aspect, either alone or in combination with any other aspect, further comprising: transporting at least a portion of undissolved waste gas within the outer tubing to a surface of the geological formation, and monitoring a composition and concentration of the undissolved waste gas, a composition and concentration of the aqueous solution, or both.

According to a sixteenth aspect, either alone or in combination with any other aspect, further comprising increasing a gas flow rate of the waste gas into the wellbore to increase a concentration of the waste gas in the dissolved waste gas solution, as determined by the monitoring of the undissolved waste gas transported to the surface of the geological formation, the aqueous solution, or both.

According to a seventeenth aspect, either alone or in combination with any other aspect, further comprising changing an aqueous solution flow rate of the aqueous solution into the wellbore to increase a concentration of the waste gas in the dissolved waste gas solution, as determined by the monitoring of the undissolved waste gas transported to the surface of the geological formation, the aqueous solution, or both.

According to an eighteenth aspect, either alone or in combination with any other aspect, transporting at least a portion of aqueous solution within the geological formation to a surface of the geological formation, and monitoring a composition and concentration of the aqueous solution.

According to a nineteenth aspect, either alone or in combination with any other aspect, wherein the waste gas enters the outer tubing under cocurrent conditions, countercurrent conditions, or both cocurrent conditions and countercurrent conditions.

According to a twentieth aspect, either alone or in combination with any other aspect, wherein the dissolved gas solution comprises carbon dioxide, hydrogen sulfide, sulfur dioxide, or combinations thereof.

According to a twenty-first aspect, either alone or in combination with any other aspect, wherein the diffusion membranes comprise a feed side and a permeate side and the waste gas enters the feed side of the diffusion membranes.

According to a twenty-second aspect, either alone or in combination with any other aspect, wherein the waste gas flows from a gas source into the inner tubing, and the gas source is positioned outside of the geological formation.

It will be apparent to persons of ordinary skill in the art that various modifications and variations can be made without departing from the scope disclosed herein. Since modifications, combinations, sub-combinations, and variations of the disclosed embodiments, which incorporate the spirit and substance disclosed herein, may occur to persons of ordinary skill in the art, the scope disclosed herein should be construed to include everything within the scope of the appended claims and their equivalents.

For the purposes of defining the present technology, the transitional phrase "consisting of" may be introduced in the claims as a closed preamble term limiting the scope of the claims to the recited components or steps and any naturally occurring impurities. For the purposes of defining the present technology, the transitional phrase "consisting essentially of" may be introduced in the claims to limit the scope of one or more claims to the recited elements, components, materials, or method steps as well as any non-recited elements, components, materials, or method steps that do not materially affect the novel characteristics of the claimed subject matter. The transitional phrases "consisting of" and "consisting essentially of" may be interpreted to be subsets of the open-ended transitional phrases, such as "comprising" and "including," such that any use of an open ended phrase to introduce a recitation of a series of elements, components, materials, or steps should be interpreted to also disclose recitation of the series of elements, components, materials, or steps using the closed terms "consisting of" and "consisting essentially of." For example, the recitation of a composition "comprising" components A, B, and C should be interpreted as also disclosing a composition "consisting of" components A, B, and C as well as a composition "consisting essentially of" components A, B, and C. Any quantitative value expressed in the present application may be considered to include open-ended embodiments consistent with the transitional phrases "comprising" or "including" as well as closed or partially closed embodiments consistent with the transitional phrases "consisting of" and "consisting essentially of."

As used in the Specification and appended Claims, the singular forms "a", "an", and "the" include plural references unless the context clearly indicates otherwise. The verb "comprises" and its conjugated forms should be interpreted as referring to elements, components or steps in a non-exclusive manner. The referenced elements, components or steps may be present, utilized or combined with other elements, components or steps not expressly referenced.

It should be understood that any two quantitative values assigned to a property may constitute a range of that property, and all combinations of ranges formed from all stated quantitative values of a given property are contemplated in this disclosure. The subject matter disclosed herein has been described in detail and by reference to specific embodiments. It should be understood that any detailed description of a component or feature of an embodiment does not necessarily imply that the component or feature is essential to the particular embodiment or to any other embodiment. Further, it should be apparent to those skilled in the art that various modifications and variations can be made to the described embodiments without departing from the spirit and scope of the claimed subject matter.

What is claimed is:

1. A system for waste gas sequestration in a geological formation comprising:

a wellbore disposed within the geological formation, the geological formation comprising reactive rock;

a casing disposed within the wellbore;

inner tubing centrally disposed within the wellbore and extending downhole a depth within the wellbore, the inner tubing being a pathway for waste gas;

a water passage disposed proximate an interior surface of the wellbore and extending downhole a depth within the wellbore, the water passage being a pathway for delivering an aqueous solution;

outer tubing in fluid communication with and disposed about the inner tubing, the outer tubing comprising a plurality of chambers and a plurality of diffusion membranes disposed proximate or within the chambers, wherein the diffusion membranes are configured to selectively permit waste gas flow into an aqueous solution stream comprising at least a portion of the aqueous solution flowing within the outer tubing to thereby facilitate dissolution of the waste gas within the aqueous solution; and a formation conduit in fluid communication with the reactive rock, configured to deliver the solution of dissolved waste gas in the aqueous solution stream to the reactive rock for waste gas sequestration.

2. The system of claim 1, wherein the outer tubing is positioned within the casing disposed within the wellbore.

3. The system of claim 1, further comprising a plurality of spacers disposed proximate or within the outer tubing.

4. The system of claim 1, wherein a membrane unit comprises a portion of the outer tubing and the plurality of membrane units are connected in series between adjacent chambers.

5. The system of claim 1, wherein the diffusion membranes are disposed along an outer surface of the chambers adjacent the water passage.

6. The system of claim 1, wherein the diffusion membranes comprise silicone, polydimethylsiloxane, or combinations thereof.

7. The system of claim 1, further comprising an aqueous solution source within the geologic formation in fluid communication with the water passage.

8. The system of claim 7, further comprising a water pump disposed between the aqueous solution source and the water passage.

9. The system of claim 1, further comprising a gas pump in communication with the inner tubing.

10. The system of claim 1, further comprising a gas return passage disposed between the outer tubing and a surface of the geological formation, the gas return passage being a pathway for undissolved or insoluble gases in the outer tubing to reach the surface of the geological formation.

11. The system of claim 1, wherein the formation conduit comprises an unlined portion of the wellbore at a downhole end of the formation conduit.

12. The system of claim 11, wherein the outer tubing is disposed within the unlined portion of the wellbore.

13. The system of claim 11, wherein the outer tubing is disposed within both the casing and the unlined portion of the wellbore.

14. A method of gas sequestration of waste gas in a geological formation comprising:

forming a dissolved waste gas solution within a wellbore by:

passing waste gas through an inner tubing;

passing an aqueous solution into the wellbore through a water passage and an outer tubing comprising a plurality of diffusion membranes; and passing the waste gas through the diffusion membranes to be mixed with the aqueous solution in the outer tubing to produce the dissolved waste gas solution;

transporting at least a portion of the dissolved waste gas solution to the geological formation, and sequestering the waste gas by reacting the waste gas in the dissolved waste gas solution with reactive rock in the geological formation to form carbonates, sulfides, or combinations thereof.

15. The method of claim 14, further comprising:

transporting at least a portion of undissolved waste gas within the outer tubing to a surface of the geological formation; and monitoring a composition and concentration of the undissolved waste gas, a composition and concentration of the aqueous solution, or both.

16. The method of claim 15, further comprising increasing a gas flow rate of the waste gas into the wellbore to increase a concentration of the waste gas in the dissolved waste gas solution, as determined by the monitoring of the undissolved waste gas transported to the surface of the geological formation, the aqueous solution, or both.

17. The method of claim 15, further comprising changing an aqueous solution flow rate of the aqueous solution into the wellbore to increase a concentration of the waste gas in the dissolved waste gas solution, as determined by the monitoring of the undissolved waste gas transported to the surface of the geological formation, the aqueous solution, or both.

18. The method of claim 14, further comprising:

transporting at least a portion of aqueous solution within the geological formation to a surface of the geological formation; and monitoring a composition and concentration of the aqueous solution.

19. The method of claim 14, wherein the waste gas enters the outer tubing under cocurrent conditions, countercurrent conditions, or both cocurrent conditions and countercurrent conditions.

20. The method of claim 14, wherein the dissolved gas solution comprises carbon dioxide, hydrogen sulfide, sulfur dioxide, or combinations thereof.

* * * * *